United States Patent [19]

Grim

[11] Patent Number: 4,951,010

[45] Date of Patent: Aug. 21, 1990

[54] POLARIZATION ROTATING APPARATUS FOR MICROWAVE SIGNALS

[75] Inventor: Fay Grim, Port Charlotte, Fla.

[73] Assignee: Maxi Rotor, Inc., Port Charlotte, Fla.

[21] Appl. No.: 324,248

[22] Filed: Mar. 15, 1989

[51] Int. Cl.[5] ..... H01P 1/165

[52] U.S. Cl. ..... 333/21 A; 343/756

[58] Field of Search ..... 333/21 A; 343/756, 909

[56] References Cited

U.S. PATENT DOCUMENTS

| | | | |
|---|---|---|---|
| 2,628,278 | 2/1953 | Zaleski | 333/21 A |
| 3,287,729 | 11/1966 | Mark et al. | 343/756 |
| 3,296,558 | 1/1967 | Bleackley | 333/21 A |
| 3,924,205 | 12/1975 | Hansen et al. | 333/21 A |
| 4,375,052 | 2/1983 | Anderson | 333/21 A |
| 4,503,379 | 3/1985 | Raiman | 333/21 A |
| 4,755,777 | 7/1988 | Cohen et al. | 333/21 A X |
| 4,829,313 | 5/1989 | Taggert | 333/21 A X |

*Primary Examiner*—Paul Gensler

*Attorney, Agent, or Firm*—Pettis & McDonald

[57] ABSTRACT

Apparatus is disclosed for rotating the polarization of microwave signal received into a circular waveguide. This apparatus includes a septum mounted within a waveguide, with that septum including a plurality of discrete interlinked elements mounted to a shaft supported longitudinally of the axis of the waveguide and includes apparatus for rotating adjacent elements angularly about the shaft along with structure for restricting the relative angular rotation of adjacent such elements about the shaft so that the maximum rotation of each element relative to an adjacent element is limited to a predetermined angle for that element.

10 Claims, 1 Drawing Sheet

POLARIZATION ROTATING APPARATUS FOR MICROWAVE SIGNALS

FIELD OF THE INVENTION

This invention relates to apparatus for rotating the plane of polarization of an electromagnetic wave. More particularly, it relates to waveguide apparatus for rotating the plane of polarization of a microwave signal being received therethrough.

BACKGROUND OF THE INVENTION

When microwave signals are relayed from transmitters to receivers, the respective transmitting and receiving antennae are oriented for either horizontal or vertical polarization of the signal wave. In various types of equipment, such as used with satellites for relaying microwave signals for television, the equipment may utilize both horizontal and vertical polarization, both on ground stations and on the satellite transponders. This has the beneficial effect of doubling the available channels for a fixed number of frequency bands. Typically, odd numbered transponders (1, 3, 5, etc.) utilize vertical polarization while the even numbered transponders (2, 4, 6, etc.) utilize horizontal polarization. This method of polarization change between adjacent transponders acts to produce increased discrimination and reduced interference that might cause deterioration of the signal from the desired transponder. However, at a ground based receiver or "earth station" proper reception of the desired signals requires that the polarization of the antenna correspond to that of the transponder from which the signals are being sent back to earth. Thus, if the desired signal is vertically polarized, then the earth station antenna must likewise be vertically polarized. Conversely, if the desired signal from the transponder is horizontally polarized, the earth station antenna must also be horizontally polarized.

One approach to providing for reception of both horizontally and vertically polarized signals has been the utilization of dual receiver waveguides, one being horizontally polarized and the other being vertically polarized. Such dual polarization of antennas, however, requires duplication of expensive components, which may not be practical for certain price-sensitive markets, such as the home satellite television antenna market.

Efforts at providing simplified dual polarization receiving antennae have been made in the past. These are generally directed to the provision of a septum extending transversely across a circular waveguide, with the outer or signal receiving end being oriented normal to the direction of polarization of an incoming microwave signal. In this orientation the septum will not block or materially attenuate the incoming microwave nor cause reflections to occur as long as the septum is a relatively thin element. After the microwave has passed by the septum it will reform into a wave identical to that of the original, with the electric field lines being at all points normal to the septum. If the outer end of the septum is twisted, with the signal receiving entrance portion being positioned normal to the polarization of the incoming wave, the polarization of the wave passing through the waveguide can be rotated by virtue of the electric field lines remaining normal to the septum. Thus, by so twisting the septum the polarization of the signal as it passes through the waveguide of the receiving antenna can effectively be rotated to a relationship convenient for the remainder of the waveguide system.

Typical of prior art devices for rotating polarization of microwave have been structures shown in the patent to Raiman, U.S. Pat. No. 4,503,379 and to Bleackley, U.S. Pat. No. 3,296,558. Raiman teaches a septum formed of a continuous, serpentine-shaped, electrically conductive filament with the outer, signal receiving end being rotatable relative to a fixed inner portion and using a remotely controlled motor to rotate that outer portion. Bleackley teaches a structure having a plurality of pins mounted to a central torsion wire with the inner end of the wire being fixed and the outer end of the wire being rotatable about the axis of the torsion wire by rotation of a permanent magnet about the outside of the waveguide.

While these and other prior art structures have provided some capability for rotating the polarization of signals, they have both suffered from the complexity and expense that is generally attendant upon the manner in which they are fabricated and in which the elements are rotated. These expenses and inconveniences have limited their usefulness in price-sensitive applications.

SUMMARY OF THE INVENTION

To overcome the problems attendant on the prior art devices, it is an object of the present invention to provide apparatus for rotating the polarization of microwave signals that is relatively simple and inexpensive. It is a further object to provide such apparatus in which the manner of effecting rotation is relatively simple and in which actuation of the apparatus can easily be effected. To provide for these and other objects, which will become apparent to those skilled in the art, the present invention provides a type of apparatus for rotating the polarization of a microwave signal. This apparatus includes a circular waveguide having a cylindrical axis longitudinally therethrough with opposed signal receiving and signal transmitting ends, a support mounted within and extending transversely to the waveguide, a shaft having opposed first and second ends and a longitudinal axis extending within the waveguide generally parallel to the cylindrical axis with the first end of the shaft being fixed to the support. There is further included a septum comprising a plurality of discrete interlinked elements mounted on the shaft for rotational movement relative to the shaft, apparatus for rotating the elements angularly about the shaft and structure for restricting relative angular rotation of adjacent such elements about the shaft, with a maximum rotation of each element relative to an adjacent element being limited to a predetermined angle for that element.

BRIEF DESCRIPTION OF THE DRAWINGS

Particularly preferred embodiments of the present invention are illustrated in the accompanying drawings in which.

DESCRIPTION OF PREFERRED EMBODIMENTS

Figure 1:
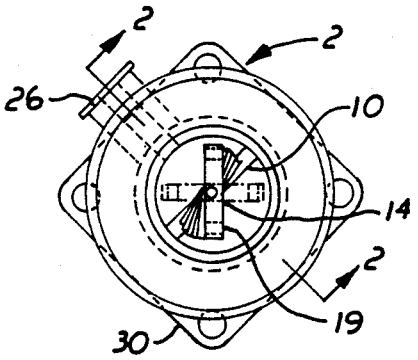
FIG. 1 represents a front view of the polarity rotating apparatus of the present invention with the polarity rotating element thereof shown in the solid line representation in a position for reception of a horizontally polarized signal and, in the broken line representation for use with a vertically polarized signal.

The illustrations depict several preferred embodiments of the apparatus of this invention. One particularly preferred embodiment is that shown in the front view of FIG. 1 and the side sectional view of FIG. 2. This apparatus comprises, in general, a circular waveguide generally indicated by reference number 2 and having a cylindrical axis 4 extending longitudinally therethrough. The waveguide 2 is open on both axial ends, which comprise opposed signal receiving end 6 and signal transmitting end 8. Mounted within and extending transversely to the waveguide is a support 10, which suitably may be formed of an electrically conducting material, such as aluminum, conveniently having a thickness on the order of about one-eighth inch, although thinner material may be fully suitable. This support 10 may be mounted within the waveguide by any convenient means, such as by interfering reception into a pair of opposed grooves such as grooves 12 shown on the waveguide of FIG. 4, or by other convenient means of affixation. Affixed to the support 10 is a shaft 14, shown in phantom in FIG. 2 and more clearly on the expanded view of FIG. 5. This shaft 14 has opposed first and second ends with the first end being affixed to the support 10 and has a longitudinal axis extending within the waveguide generally parallel to the cylindrical axis 4 and preferably coaxial therewith.

Figure 2:
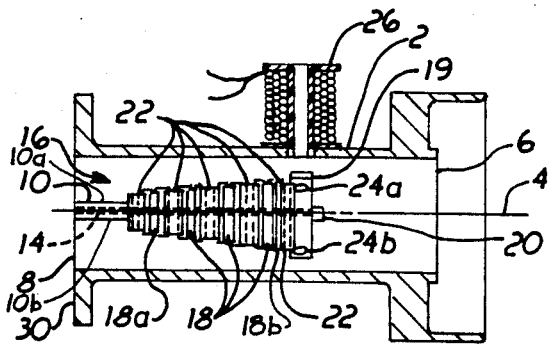
FIG. 2 is a side sectional view taken along lines 2—2 of FIG. 1.

Mounted on the shaft 14 is the septum of this polarization rotating apparatus, with that septum being generally indicated by reference numeral 16. As shown in FIG. 2 and more clearly in the schematic, expanded view of FIG. 5, the septum 16 comprises a plurality of discrete interlinked elements 18 mounted on the shaft 14 for rotational movement relative thereto. This septum 16 includes a first such element 18*a* that is positioned adjacent the support 10 and a next to last element 18*b* distal that support 10. A suitable retaining element 20, such as a frictionally or threadably engaging cap, is attached to that distal end of the shaft 14 to retain the elements 18 on the shaft.

Figure 5:
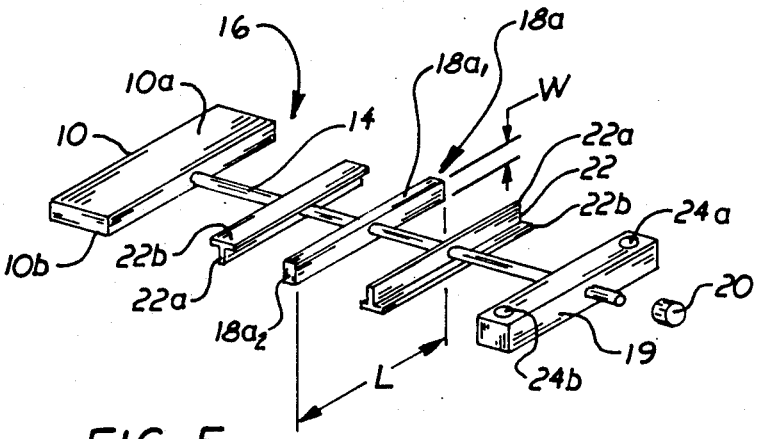
FIG. 5 is an expanded schematic representation of the signal rotating components of the apparatus of this invention, including the signal rotating elements and adjacent spacer.

Each of the elements 18 preferably is formed of a suitable electrically conductive material, such as aluminum, brass, or the like and may be of comparable thickness to the support 10. Each of these elements 18, as well as final element 19, have a predetermined length L measured transverse to the shaft and a predetermined width W measured normal both to the predetermined length and to the axis of the shaft. Each of these elements 18 also has a first side and a second side extending transverse to the circular waveguide with the axis of the shaft 14 extending through the member intermediate the first and second sides. In FIG. 5, for typical element 18*a*, the first side corresponds to reference designator 18*a*, and the second side corresponds to reference number 18*a*. These first and second sides correspond generally to sides 10*a* and 10*b*, respectively, of the support, in which the axis of the shaft 14 likewise extends through that support member 10 intermediate those first and second sides.

Provided with this septum also are additional means, which conveniently may be spacers 22, for restricting relative angular rotation of adjacent elements 18 about the shaft, whereby the maximum rotation of each element relative to an adjacent element is limited to a predetermined angle for that element. These spacers 22 include one such spacer interposed between each adjacent pair of the elements 18, with a first portion 22*a* extending transverse to the shaft 14 with the shaft extending through two opposed sides thereof, and a second portion 22*b* that is joined to the first portion 22*a* at a space from the shaft 14 axis a distance greater than half the width of the element 18. This second portion 22*b* extends transversely to the first portion 22*a* and extends generally longitudinally of the shaft 14 a distance on each side of the first portion 22*a* sufficient to overlap a portion of each adjacent element 18, as best shown in FIG. 2. An additional such spacer 22 is interposed between the support 10 and the first element 18*a* with that spacer second portion 22*b* extending longitudinally of the shaft 14 on the side of the first portion proximal the support a distance sufficient to overlap a portion of side 10*a* of that support and extending longitudinally of the shaft on the side of the spacer first portion 22*a* proximal the first element 18*a* a distance sufficient to overlap a portion of that first element 18*a*, in this case, overlapping a portion of the first side 18*a*. The spacers conveniently may be formed of any suitable dielectric material, such as nylon or polytetrafluorethylene or other suitable insulating materials.

As shown in FIGS. 2 and 5, the septum 16 includes a number of these spacers 22, with alternating spacers being mounted on the shaft 14 with their second portion 22*b* on opposite sides of the shaft. For the sake of convenience, the spacers may be referred to as alternating first and second spacers, with the first spacers having the second portion 22*b* overlapping portions of adjacent elements on the first side thereof, such as $18a_1$, and the second spacers overlapping portions of the second sides, such as $18a_2$, of adjacent elements 18.

Figure 3:
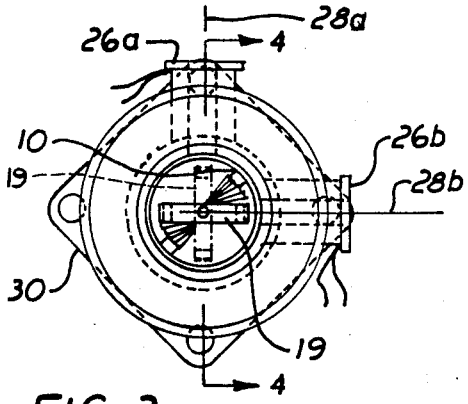
FIG. 3 is a front view of a second embodiment of the apparatus of this invention.

In FIGS. 2 and 5 the spacers are illustrated as being formed conveniently of a dielectric material having a generally T-shaped cross sectional configuration taken longitudinally of the shaft axis. Thus, the spacer first portion corresponds to the upright of the "T" with the second portion of the spacer corresponding generally to the crossbar of the "T." The overlapping arrangement of the spacer second portion 22*b* with regard to adjacent septum elements 18 causes rotation of one such element 18 about the shaft 14 to urge rotation in the same direction of adjacent such elements. By having the second portion or crossbar of the spacer 22 located a distance from the axis of the shaft 14 greater than half the width of each adjacent element 18, some freedom of movement or "play" may exist between adjacent elements and spacers. Thus, rotation of one element a predetermined amount will effect rotation of an adjacent element generally by a slightly lesser amount. By appropriate selection of the relative dimensions and number of spacers and elements along the shaft, last element 19 may rotate a fixed amount, conveniently 45 degrees as shown in FIGS. 1 and 3, relative to the fixed support 10, with the interlinked elements between the support 10 and the last element 19 each rotating incrementally less than the amount of the last element 19. This provides for a relatively smooth helical twist to the septum, as shown in FIGS. 1, 2 and 3.

To provide for rotation of the septum, two preferred mechanisms are illustrated in FIGS. 1 through 4. In FIGS. 1 and 2 the rotating mechanism is shown as comprising magnetically attractable means, such as small but powerful permanent magnets 24*a* and 24*b* that are connected to or preferably mounted within the last septum element 19. These permanently magnetic elements 24*a* and 24*b* suitably have a fixed polarization. Mounted to the waveguide 2 is a suitable actuator in the form of a selectively energizable electromagnetic means 26, which may be a relatively simple electromagnet, which suitably may be positioned radially of the axis 4 of the waveguide and normal to the planes defined by the first and second surfaces of the support 10. Thus, by activation of the electromagnet 26 with a current having one polarity, electromagnet 26 will attract the magnetic element 24*a* in the last septum element 19 to rotate counterclockwise as shown in the solid line representation in FIG. 1. By reversing the polarity of the current to electromagnet 26, the magnetic element 24*a* in the last septum element 19 may then be repelled and magnetic element 24*b*, of opposite plurality, attracted, rotating the last septum element 19 in the opposite, clockwise direction around shaft 14 to the position shown in the dotted line representation in FIG. 1. Thus, with the septum element rotated to the first position, shown in the solid line representation of FIG. 1, the apparatus of this invention is configured to receive signals that are horizontally polarized and to incrementally reorient them 45 degrees for reception into a waveguide attached to the flange 30 at the signal transmitting end 8 of the waveguide for subsequent amplification and processing. Conversely, in the second condition of energization of the electromagnet 26, with the last septum element 19 rotated to the position shown in the broken line representation of FIG. 1, the apparatus is configured for optimal reception of microwave signals that are vertically polarized, then incrementally rotating the polarization of that signal to a position normal to the support 10 and then again into the waveguide apparatus attached to the flange 30.

Figure 4:
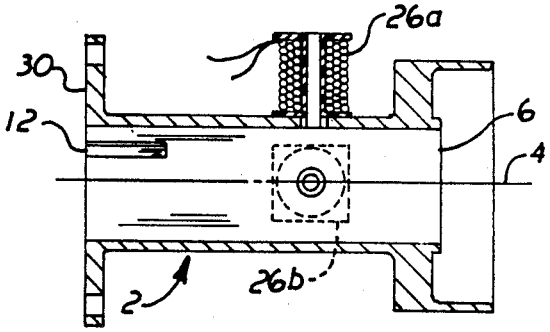
FIG. 4 is a side sectional view of the waveguide of the apparatus of FIG. 3, taken along lines 4—4, with the signal rotating elements omitted for clarity.

A slightly different version of the apparatus of this invention is illustrated in FIGS. 3 and 4. This apparatus utilizes plural, in this case two, electromagnets mounted to the waveguide at angularly spaced radial positions. Suitably, these positions are normal to one another and generally in the same plane transverse to the axis of the waveguide. Conveniently, one of the actuators 26*a* may be oriented generally perpendicular to the plane of the broad surfaces of the support 10, with the other actuator 26*b* being generally parallel to those planes. This embodiment operates in a manner substantially similar to that of the embodiment of FIGS. 1 and 2 with the two electromagnets 26*a* and 26*b* both being energized with current of the same polarity but of selectively variable levels. If a strong current were applied to electromagnet 26*b* and substantially no current applied to electromagnet 26*a*, the last element 19 of the septum would be attracted to line up generally with the axis 28B through the pole piece of magnet 26*b*, thus orienting the septum for optimal reception of signals having a vertical polarization. Conversely, if a substantial current were applied to electromagnet 26*a* with substantially no current applied to electromagnet 26*b*, the last element 19 would line up generally with the axis 28*a* through the pole piece of magnet 26*a*, thus optimizing the septum for reception of signals having a vertical polarity. Obviously, by varying the relative levels of current flowing in electromagnets 26*a* and 26*b*, their levels of attraction can be balanced and adjusted so that the septum last element 19 can be driven to any desired angle of rotation between the axes 28*a* and 28*b*. This may be useful in some situations in which polarization has become somewhat skewed instead of being truly horizontal or truly vertical. Obviously, simple and conventional means such as rheostats and other variable power supplies well known to those in the art may be utilized for energizing the electromagnets in this invention. Also, it should be apparent that the electromagnets 26*a* and 26*b* could be oriented at angles other than normal to one another, if so desired.

Figure 6:
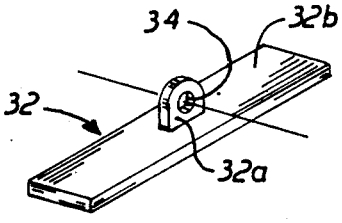
FIG. 6 is a perspective view on an enlarged scale of a second type of spacer for use with the apparatus of FIG. 5.
Figure 7:
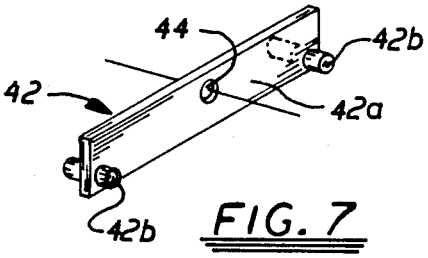
FIG. 7 in a perspective view on an enlarged scale of a third type of spacer for use with the apparatus of FIG. 5.

In FIGS. 6 and 7 are shown other embodiments of the spacers utilized to separate the elements 18 of the septum. In FIG. 6, spacer 32, corresponding to spacer 22 of FIG. 5, includes a first portion 32*a* that extends transverse to the axis of the aperture 34 through which the shaft 14 is received. Additionally, a second portion 32*b* is joined to the first portion 32*a* at a space from the axis of the aperture 34*a* a distance greater than half the width W of an element 18. This spacer 32 is, like spacer 22, fabricated of a suitable dielectric material, such as nylon, polyethylene, or other suitable synthetic resin known to those skilled in the art. The second portion 32*b* of the spacer extends transversely to the first portion 32*a* and generally longitudinally of the axis of the aperture 34 a distance on each side of the first portion 32*a* sufficient to overlap a portion of each adjacent element 18, in the manner shown in FIG. 2.

FIG. 7 illustrates yet another suitable embodiment of the spacer that is interposed between adjacent elements 18 of the septum. In this embodiment, the spacer first portion 42*a* may be formed of a flat strip of a suitable dielectric material, as with the previous spacers, with the elements 42*b* comprising projections extending from the first portion 42*a* or, preferably pin-like elements inserted through the first portion 42*a*. As with the spacers 22 and 32, the first portion 42*a* extends transverse to the axis of the aperture 44 through which is received the shaft 14. The second portions 42*b* are positioned such that a plane tangential to the upper surface of the respective elements 42*b* in FIG. 7 is spaced a distance from the axis of the aperture 44 greater than half the width of the elements 18 of the septum. The spacer second portions 42*b* extend transversely of the first portion 42*a* and generally longitudinally of the axis of aperture 44 a distance on each side of the first portion 42*a* sufficient to overlap a portion of each adjacent element 18, in the manner generally shown in FIG. 2.

While the foregoing has described several particularly advantageous embodiments of the apparatus of this invention, it is to be understood that these descriptions are illustrative only of the principles of the invention and are not to be considered limitative thereof. Accordingly, because numerous variations and modifications of this structure, all within the scope of the invention, will readily occur to those skilled in the art, the scope of the invention is to be limited solely by the claims appended hereto.

What is claimed is:

1. Apparatus for rotating the polarization of a microwave signal comprising:

a circular waveguide having a cylindrical axis extending longitudinally therethrough, said waveguide being open on both axial ends and having opposed signal receiving and signal transmitting ends;

a support mounted within and extending transversely to said circular waveguide;

a shaft having opposed first and second ends and a longitudinal axis extending within said waveguide generally parallel to said cylindrical axis, said shaft first end being affixed to said support;

a septum comprising a plurality of discrete interlinked elements formed of electrically conductive material mounted on said shaft for rotational movement relative thereto, said septum having a first element adjacent said support and a last element distal said support;

rotating means for rotating said elements angularly about said shaft while said shaft remains substantially stationary; and means for restricting relative angular rotation of adjacent said elements about said shaft, whereby the maximum rotation of each element relative to an adjacent element is limited to a predetermined angle for that element.

2. The apparatus of claim 1 wherein said support comprises a member having generally opposed first and second sides extending transverse to a said circular waveguide with said axis of said shaft extending through said support member intermediate said first and second sides thereof.

3. The apparatus of claim 2 wherein said elements comprise elongated members each having a predetermined length measured transverse to said shaft and a predetermined width measured normal to said predetermined length and to the axis of said shaft, said members each having first and second sides extending transverse to said circular waveguide with the axis of said shaft extending through said member intermediate said first side of said member and said second side of said member.

4. The apparatus of claim 3 wherein said rotation restricting means comprises:

a plurality of spacers with at least one said spacer interposed between each adjacent pair of said elements, a first portion of said spacer extending transverse to said shaft with said shaft extending through two opposed sides thereof and a second portion of said spacer joined to said first portion and spaced from said shaft axis a distance greater than one-half said width of said element, said second portion extending transversely to said first portion and generally longitudinally of said shaft a distance on each said side of said first portion sufficient to overlap a portion of each said adjacent element, and an additional said spacer interposed between said support and said first element with said spacer second portion extending longitudinally of said shaft on the side of said first portion proximal said support a distance sufficient to overlap a portion of one of said sides of said support and extending longitudinally of said shaft on the side of said spacer first portion proximal said first element a distance sufficient to overlap a portion of said first element.

5. The apparatus of claim 4 wherein said plurality of spacers comprises alternating first and second said spacers with one said second spacer and two said septum elements interposed between each adjacent pair of said first spacers and with said second portions of said first spacers overlapping portions of said first sides of adjacent said septum elements and said second portions of said second spacers overlapping portions of said second sides of adjacent said septum elements, whereby the second portions of adjacent spacers alternate on generally opposite sides of the shaft.

6. The apparatus of claim 4 wherein said septum elements are formed of an electrically conductive material and said spacers are formed of a dielectric material.

7. The apparatus of claim 6 wherein said spacers are formed of a dielectric material having a generally T-shaped cross sectional configuration taken longitudinally of said shaft axis.

8. The apparatus of claim 1 wherein said rotating means comprises magnetically attractable means carried by said shaft for rotational movement about said shaft and being connected to said last septum element for urging rotation of said last septum element generally therewith, and selectively energizable electromagnetic means for urging rotation of said magnetically attractable means about said shaft in a counterclockwise direction in a first condition of said selective energization and in a clockwise direction in a second condition of said selective energization, whereby rotation of the last septum element and other interlinked septum elements may be effected in either such direction about the shaft.

9. The apparatus of claim 8 wherein said selectively energizable electromagnetic means comprises an electromagnet having selectively reversible polarity, and said magnetically attractable means comprises at least one member having predetermined magnetic polarity, whereby the electromagnet will attract the magnetically attractable member when energized to have a first polarity and will repel the magnetically attractable member when energized to have a second, opposite polarity.

10. The apparatus of claim 8 wherein said selectively energizable electromagnetic means comprise a plurality of electromagnets mounted to said waveguide at angularly spaced radial positions such that, in said first condition of energization of said electromagnet, said magnetically attractable means is attracted toward a first said electromagnet, and, in said second condition of energization of said electromagnets, said magnetically attractable means is attracted toward a second said electromagnet whereby the angle of rotation of the septum elements is controllable by selective application of the first and second conditions of energization of the electromagnets.

* * * * *